US006773183B2

(12) United States Patent
Geddes et al.

(10) Patent No.: US 6,773,183 B2
(45) Date of Patent: Aug. 10, 2004

(54) WRITING INSTRUMENT OF UNIQUE DESIGN

(76) Inventors: William Thomas Geddes, 11107 Powers Ave., Cockeysville, MD (US) 21030; Jennifer Weaver, 3518 Millvale Rd., Baltimore, MD (US) 21244

( * ) Notice: Subject to any disclaimer, the term of this patent is extended or adjusted under 35 U.S.C. 154(b) by 0 days.

(21) Appl. No.: 10/241,599

(22) Filed: Sep. 10, 2002

(65) Prior Publication Data

US 2004/0047668 A1 Mar. 11, 2004

(51) Int. Cl.[7] ..... A46B 5/02
(52) U.S. Cl. ..... 401/6; 16/430

(58) Field of Search ..... 16/430; 401/6, 401/99, 88, 101, 109

(56) References Cited

U.S. PATENT DOCUMENTS 1,950,960 A * 3/1934 Wisser ..... 33/27.02
5,651,626 A * 7/1997 Chen ..... 401/104
6,464,419 B1 * 10/2002 Chan ..... 401/131

* cited by examiner

*Primary Examiner*—David J. Walczak
(74) *Attorney, Agent, or Firm*—Mishrilal Jain

(57) ABSTRACT

A unique writing instrument. Preferred is a bow shaped barrel with an arched and hinged or flexible upper member and a rigid lower member. A method of producing the writing instrument is also described.

3 Claims, 3 Drawing Sheets

Extensions of Ball Point

WRITING INSTRUMENT OF UNIQUE DESIGN

FIELD OF THE INVENTION

The present invention relates to a writing instrument. In particular, the present invention relates to an article that comprises a light weight, novel and comfortable writing instrument shaped in a unique configuration that includes a rigid barrel and a flexible member to accommodate different writing styles. More particularly, the present invention is related to a writing instrument comprising a split barrel having an arched flexible or jointed upper barrel which collapses in controlled fashion upon pressure from the instrument user and a lower rigid barrel, and a method of making said article.

BACKGROUND OF THE INVENTION

Currently many pens and other writing instruments have a cylindrical or hexagonal barrel of uniform shape along the length of the barrel. Various comfort means, such as soft rubber or foam grips or textured areas, are often added to conventional writing instruments to accommodate a user's particular grip. The present invention offers a novel design which incorporates an arched flexible upper barrel with a rigid lower barrel. The upper barrel collapses downward in a controlled fashion in relation to the degree of pressure the user places upon the instrument This movement accommodates an individual user's writing style by narrowing the grip area consistent with the degree of pressure exerted upon the instrument by the user.

The upper barrel may have a hinged movement, which may also be adopted in a mechanical pencil or a retractable ball point pen, and the like. Conventional retractable pens or mechanical pencils frequently provide for the extension mechanism at the opposite end of the writing instrument from the writing tip. Some retractable pens and mechanical pencils have the extension mechanism further down th barrel of the instrument toward the writing tip; however, such instruments require the user to depress a button like device. The present invention alleviates the need to depress any type of raised button like device in order to operate the extension and retraction mechanisms found on other instruments and thus provides for greater convenience and ease of extending the pencil lead or ball point nib. Pressure exerted upon the hinged area of the upper member may trigger the mechanism to extend the lead refill in a mechanical pencil or the ball point nib on a ball point pen. From an aesthetic standpoint, the instrument presents a novel design which is unique, lightweight, comfortable and pleasing to the user, and distinctive from other writing instruments currently available on the market.

Accordingly, there is a need for providing a writing instrument that accommodates the pressure an individual user places upon a writing instrument through a hinged or flexible upper member and a rigid lower member, whereby the upper member collapses in a controlled and varied fashion downward toward the lower member. There is an additional need to provide a writing instrument that provides for extending the lead refill of a mechanical pencil or a ball point nib in a retractable pen without the need for actuating a separate raised button like device on the writing instrument. In addition, there is a need to provide a writing instrument with a novel design, that is pleasing, comfortable, lightweight and easy to manufacture.

SUMMARY OF THE INVENTION

Accordingly, it is an advantage of the present invention to meet these and other needs by providing a writing instrument comprising an upper arched member and a lower rigid member.

It is another object of the invention to provide a writing instrument with an arched upper barrel like member that is hinged or flexible so that it collapses downward toward the lower member, which may be curved or straight with or without different shapes.

It is still another object of the invention to provide a writing instrument with an extension and retraction mechanism located within the upper flexible or hinged member.

Another advantage of the invention is that it provides for a controlled collapse of the upper member consistent with the pressure applied to it by the user, thus accommodating an individual user's grip.

It is still another object of the invention to provide a writing instrument that is pleasing and comfortable to hold.

It is yet another object of the invention to provide a writing instrument that is simple in construction, unique in design, low in cost, lightweight and easy to manufacture.

To achieve the stated and other advantages of the present invention, as embodied and described below, the invention includes a writing instrument, comprising an arched, hinged or flexible upper member which collapses downward as pressure is applied to it, and a rigid lower member providing comfortable use of the article.

Additional advantages and novel features of the invention will be set forth in part in the description that follows, and in part will become more apparent to those skilled in the art upon examination of the following description of the drawings or upon learning by practice of the invention.

BRIEF DESCRIPTION OF THE DRAWINGS

Reference will now be made in detail to embodiments of the present invention, examples of which are only illustrative in the accompanying drawings.

FIG. 1 also depicts the pen with the upper member fully depressed.

DETAILED DESCRIPTION OF THE INVENTION

The invention includes a writing instrument so as to provide a curved or bowed design with an arched upper member and a rigid lower member. When operating the instrument, the upper member conforms to the general curvature of the operator's hands, while the lower member provides a support for the user's thumb. A unique aspect of this invention is within the upper member and comprises a hinged or otherwise flexible feature. This feature allows the upper member to adjust downward consistent with the degree of pressure exerted by the user to grasp the instrument (see FIG. 1).

Figure 1:
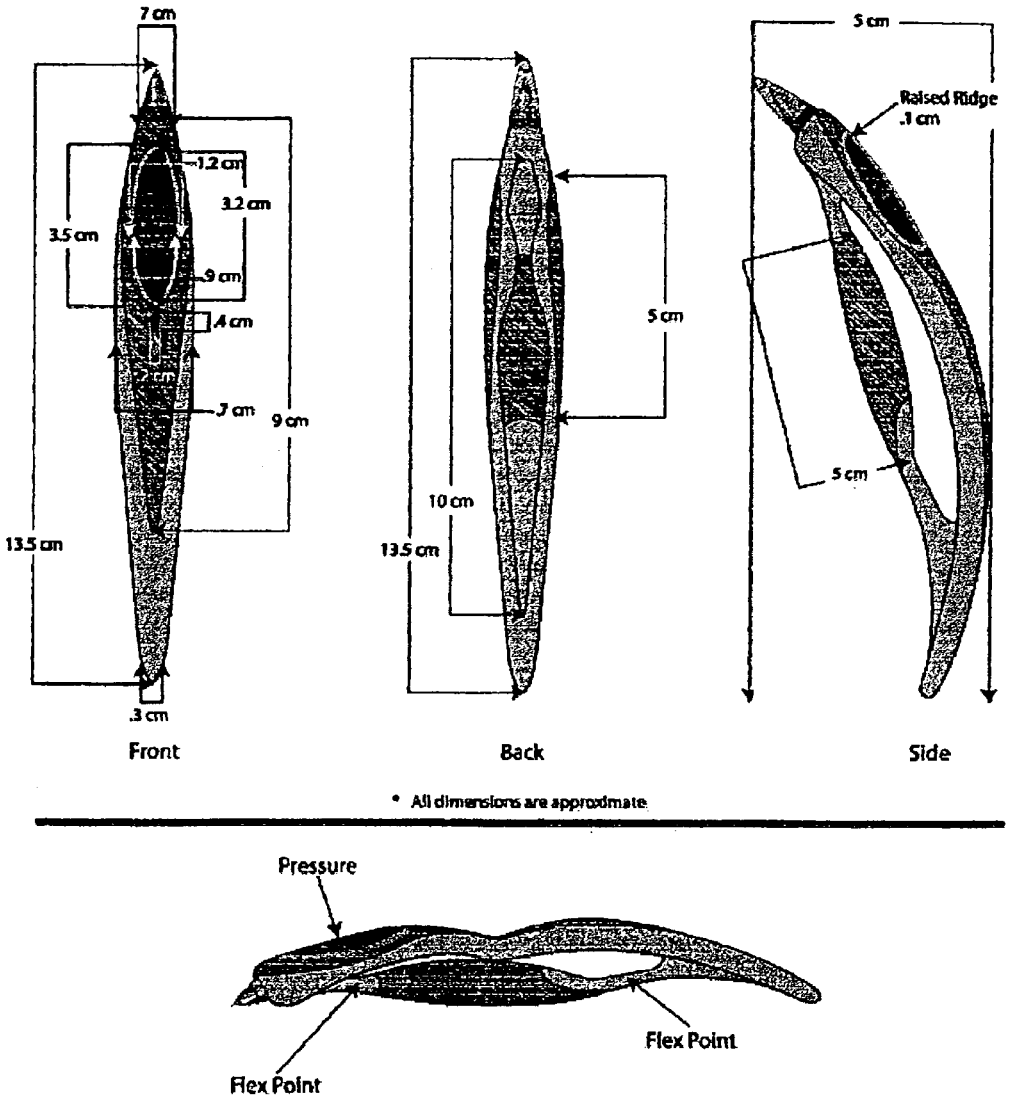
FIG. 1 exemplifies the shape and approximate dimensions of the invention from the top, bottom and side view and illustrates grip areas as applied to a conventional "stick" type ball point pen.
Figure 2:
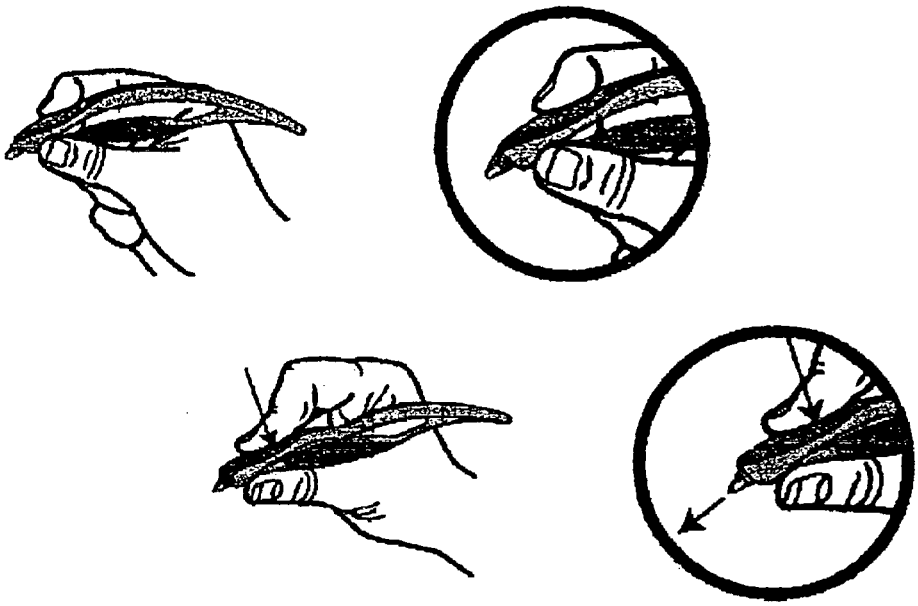
FIG. 2 demonstrates the invention as applied to a retractable ball point pen.
Figure 3:
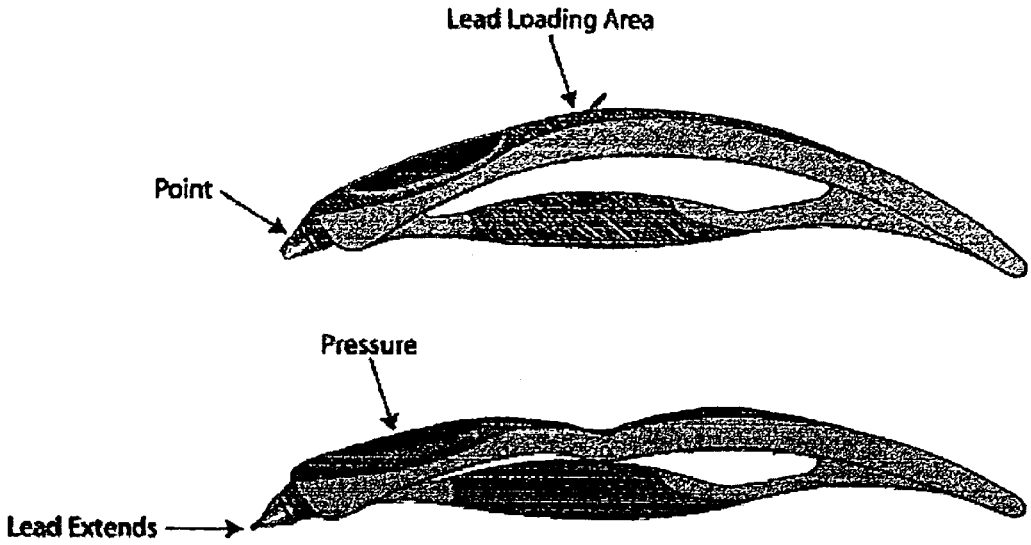
FIG. 3 demonstrates the invention as applied to a mechanical pencil.

In addition, the hinged feature may be used to operate an extension and retraction mechanism for a retractable pen or mechanical pencil (see FIGS. 2 and 3, respectively). The retractable pen tip or nib would be extended and retracted upon depression of the hinged area of the upper member (see FIG. 1). As typical with most retractable pens, the nib would be extended upon depression of the hinged area and retracted upon a subsequent depression of that area (see FIG. 2).

The mechanical pencil feature of the invention would comprise a lead loading area noted in FIG. 3, and a lead advancement mechanism housed within the instrument and operated by depressing the hinged area of the upper member (see FIG. 3).

It should be understood that unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the methods and materials described herein are preferred. Unless mentioned otherwise, the techniques employed or contemplated herein are standard methodologies well known to one of ordinary skill in the art The materials, methods and examples are only exemplary and not limiting.

The term "arched" as used herein refers to the shape of the upper member and represents a bowed or curved shape without regard to the degree of curvature.

The term "barrel" as used herein refers to the body of a writing instrument which houses the material used for writing, as well as any mechanism for retracting or extending the writing material.

Of course, a writing instrument includes a pen, a pencil, and the like.

FIG. 1 illustrates the front, back and side views of the invention. As depicted in FIG. 1, the invention contains a conventional ball point pen with an ink refill. Immediately next to the ball point and nib is a soft grip which provides a cushioned area at which the users finger tips rest during the pen operation. At a point adjacent to the soft grip area is the hinged or flexible feature of the upper member referred to in FIG. 1 as the "Flex area." The lower member remains static and provides for support while the upper member is depressed. Thus the range of flexibility of the upper member is limited by contact with the lower member (see FIG. 1).

Beginning adjacent to the writing tip area of the invention, the instrument takes on the shape of a bow. From the area immediately adjacent to the writing tip, the instrument forks into two members along the central portion of the instrument creating a narrow void between the upper and lower members. The upper and lower members rejoin at a point near the end of the instrument at a flex point as noted in FIG. 1.

FIG. 2 illustrates the method by which the invention would be used as a retractable pen.

FIG. 3 illustrates the method by which the invention would be used as a mechanical pencil.

In a preferred embodiment of the invention, the device comprises hollow portion in the upper member which houses an ink cartridge and ball point tip or nib, the device being divided into an upper and lower member, with the upper member capable of being depressed downward toward and resting upon the lower member.

In another embodiment of the invention, the article comprises a bow shaped barrel with an arched upper member containing a joint or flexible feature with a flex point located at either end of the lower member to provide the upper member with the capability of being depressed. Along the top of the upper member toward the writing point, and along the lower member, the soft grip device is located.

A method of making the article, comprises the following steps:

(i) developing an injection mold for the skeleton of the instrument which comprises a hard plastic instrument body;

(ii) injection-molding of the skeleton of the instrument including plastics producing a single color for the writing instrument body;

(iii) verifying that the injection process created acceptable molded pieces;

(iv) developing an injection mold for soft grip material being located along rigid lower member;

(v) injection-molding the soft grip material onto the hard plastic skeleton;

(vi) verifying that the injection process created acceptable molded pieces;

(vii) developing an injection mold for the cap and writing point of the instrument;

(viii) injection-molding cap and writing point of the instrument;

(ix) verifying that the injection process created acceptable molded caps and points;

(x) electroplating the points to create a metallic finish;

(xi) verifying that the electroplating process created an acceptable finish;

(xii) assembling the ball point ink cartridge and point onto the body of the instrument; and (xiii) screenprinting any logos or graphics on the body of the instrument Of course, having learnt the teachings of the present invention, one skilled in the art may vary the manufacturing process or design and configuration in different ways consistent with the objectives of the present invention.

Example embodiments of the present invention have now been described in accordance with the above advantages. It will be appreciated that these examples are merely illustrative of the invention and not limitations thereof. Many variations and modifications will be apparent to those skilled in the art and all such modifications and variations are included within the purview and scope of the appended claims.

What is claimed is:

1. A writing instrument, comprising a split barrel having a lower rigid member extending in a plane and an arched hinged flexible upper member having writing material therein and extending in the same plane as said lower rigid member, which upper member collapses in a controlled manner upon pressure from the instrument user toward the lower rigid member, wherein the instrument forks into two members along the central portion of the instrument reconnecting at a flex point to form a joined member which acts to form a hinge to permit collapse of the upper member, and acting in a manner so as to create a narrow void between the upper and lower members, the instrument allowing comfortable grip while writing.

2. The instrument of claim 1, wherein the lower member is curved or straight with or without different shapes.

3. The instrument of claim 1, wherein the upper member conforms to the curvature of the user's hand, while the lower member provides support to the use's thumb through the void.

* * * * *